US008418900B1

(12) United States Patent
Baker

(10) Patent No.: US 8,418,900 B1
(45) Date of Patent: Apr. 16, 2013

(54) WEARABLE APPARATUS FOR PROVIDING SUPPORT FOR ARTICLES

(76) Inventor: Gary W. Baker, Belen, NM (US)

( * ) Notice: Subject to any disclaimer, the term of this patent is extended or adjusted under 35 U.S.C. 154(b) by 322 days.

(21) Appl. No.: 12/859,671

(22) Filed: Aug. 19, 2010

(51) Int. Cl.
*A45F 3/08* (2006.01)
*A45F 3/04* (2006.01)

(52) U.S. Cl.
USPC ..... 224/262; 224/647; 224/648

(58) Field of Classification Search ..... 224/261, 224/647, 646, 648, 262, 549, 553, 564
See application file for complete search history.

(56) References Cited

U.S. PATENT DOCUMENTS

| | | | | |
|---|---|---|---|---|
| 2,603,134 | A | 7/1952 | Burnam | |
| 2,990,089 | A | 6/1961 | Nystrom | |
| 3,273,484 | A | 9/1966 | Lapsley | |
| 3,661,308 | A * | 5/1972 | Walters | 224/258 |
| 4,156,512 | A * | 5/1979 | Brown | 248/586 |
| 4,208,028 | A * | 6/1980 | Brown et al. | 224/185 |
| 4,327,986 | A * | 5/1982 | Carter | 396/423 |
| 4,514,067 | A | 4/1985 | Gallegos | |
| 4,637,536 | A | 1/1987 | Wong | |
| 4,802,612 | A | 2/1989 | Anderson | |
| 4,991,758 | A * | 2/1991 | Eaneff | 224/625 |
| 5,207,791 | A * | 5/1993 | Scherbarth | 273/148 B |
| 5,294,947 | A | 3/1994 | Harrington | |
| 5,332,136 | A | 7/1994 | Rudolph | |
| 5,462,214 | A | 10/1995 | Buswell | |
| D364,735 | S | 12/1995 | Coates | |
| 5,528,846 | A | 6/1996 | Baggett | |
| 5,642,847 | A | 7/1997 | DeMeo et al. | |
| 5,723,808 | A | 3/1998 | Devall | |
| 5,778,589 | A * | 7/1998 | Teague | 42/94 |
| 5,806,734 | A | 9/1998 | Scott | |
| 5,930,931 | A | 8/1999 | Watson | |
| 5,988,466 | A | 11/1999 | Brown | |
| 6,254,044 | B1 | 7/2001 | Lee | |
| 6,336,576 | B1 | 1/2002 | Easter | |
| 6,629,380 | B2 * | 10/2003 | Yeargin | 42/94 |
| 6,695,188 | B1 | 2/2004 | Bradshaw et al. | |
| 6,764,231 | B1 | 7/2004 | Shubert | |
| 7,000,875 | B2 | 2/2006 | Pernstick et al. | |
| 7,191,923 | B1 | 3/2007 | Kundig | |
| 7,683,969 | B2 | 3/2010 | Callahan | |
| 2004/0211799 | A1 | 10/2004 | Loughman | |
| 2007/0090143 | A1 | 4/2007 | Clayton, III et al. | |
| 2010/0006614 | A1 * | 1/2010 | McLean et al. | 224/577 |
| 2010/0025444 | A1 | 2/2010 | Tipton et al. | |

* cited by examiner

*Primary Examiner* — Justin Larson
*Assistant Examiner* — Derek Battisti
(74) *Attorney, Agent, or Firm* — Samantha A. Updegraff; Peacock Myers, P.C.

(57) ABSTRACT

An apparatus that can be worn by a user and is capable of holding one or more articles, including but not limited to cameras, video recorders, rifles, pistols, binoculars, mobile phones, laptop computers, personal digital assistants, portable personal music players, combinations thereof, and the like.

12 Claims, 15 Drawing Sheets

WEARABLE APPARATUS FOR PROVIDING SUPPORT FOR ARTICLES

CROSS-REFERENCE TO RELATED APPLICATIONS

Not Applicable.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

COPYRIGHTED MATERIAL

Not Applicable.

BACKGROUND OF THE INVENTION

1. Field of the Invention (Technical Field)

Embodiments of the present invention relate to an apparatus which can be worn about a neck and an upper body of a user and which can fold out to provide a rest and/or mounting surface for articles including but not limited to binoculars, cameras, video recorders, firearms and the like. In one embodiment, the invention can simultaneously support a plurality of such articles.

2. Description of Related Art

Several known devices exist which are capable of providing support for articles in lieu of a user supporting the weight of the article entirely or which assists a user in supporting the weight and/or steadying the article. The most popular of these include bipods and tripods. Known bipods and tripods, however, require a surface external to the user, such as the ground, upon which to dispose them. By requiring that the known devices be disposed on a surface external to the user, such systems must thus remain fixed in a single location in order to provide desirable results. This results in a user being forced to stop and set up the bipod or tripod and thus hindering the mobility of a user. Often, this reduction in mobility leads to a significant decrease in the desirability of a particular outing, and can often cause the failure of a outing in which the user has a set objective. For example, a if a user relies on a use of a bipod to help support the weight of a firearm and the user is out on a hunting trip, often the game move across the field of view of the hunter without stopping. Because trees, brush, and other natural and man-made obstructions can block the view of game at various locations as the game passes through the hunters field of view, a user is therefore forced to set up a bipod and then move and re-set up the bipod because the game has continued to move and an obstruction has blocked the view of the game at the original location. Such a situation often results in the inability of the hunter to have a clear shot at the game, thus leading to a failed hunting trip.

Even in situations where a user need not be mobile, a tripod or bipod can also interfere with body position, especially when sitting down in a chair. Further, the relative large footprint area needed for the leg structure of known systems interfere at sporting events or concerts where there are bleachers or rows of seats or chairs, as well as during outdoor activities due to the uneven surfaces that are often encountered.

While there are a few known systems which support an article and do not require contact with a surface external to the user, such known systems have other characteristics which inhibit their use. For example, the Personal Binocular Support in U.S. Pat. No. 4,637,536 to Wilbur Wong, solves some of the tripod problems. That invention is disposed entirely in front of the user. However, that system only works with binoculars and it forces the user to look only 'straight ahead' without moving the whole upper body to view at a different angle. That system is also difficult and awkward to use due to its numerous pivot points and components that require adjustment.

The Body Mounted Camera Support Assembly disclosed in U.S. Pat. No. 5,462,214 to Brian Buswell is supported on a storage case type stand. It attaches to the waist of a user and does not have any upper support, thus forcing the user to continuously hold the article, otherwise the entire device and article tip over.

U.S. Pat. No. 5,528,846 to Bruce W. Daggett sought to address the difficulty of supporting or holding a rifle. Because that system forces a user to hold the device by the non-trigger hand, it is difficult for a user to steady the rifle while he is shooting or working the action of the rifle. This also inhibits the ability of the user to quickly load and re-load the rifle.

Embodiments of the present invention solve all of the problems that have heretofore remained unaddressed by known systems, thereby providing a hands-free, secure, support system for binoculars, cameras, video recorders, firearms, combinations thereof, and the like.

BRIEF SUMMARY OF THE INVENTION

Embodiments of the present invention preferably comprise a wearable holding apparatus for holding and/or supporting one or more articles. The wearable holding apparatus preferably includes a frame, the frame comprising a first end and a second end, a first arm assembly hingedly disposed on the first end of the frame, a second arm assembly hingedly disposed on the second end of said frame, a first mounting plate disposed on the first arm assembly; and a second mounting plate disposed on the second arm assembly. The apparatus optionally comprises at least one abdominal strap and/or at least one neck strap.

The first arm assembly of an embodiment of the present invention preferably comprises a first arm pivot point which includes a lockable pivot assembly. The lockable pivot assembly optionally comprises a splined configuration. The second arm assembly also comprises a second arm pivot point. At least one of the first pivot point and the second pivot point comprise a lockable pivot point assembly. Preferably, both first arm pivot point and second arm pivot points comprise lockable pivot point assemblies. At least one of the first mounting plate and/or the second mounting plate are movably positionably about its corresponding first arm assembly and/or second arm assembly.

The apparatus preferably comprises a plurality of strap-connector connection having at least one securing strap. The strap can be connected to a mounting plate or can be connected to the frame.

In one embodiment of the present invention, the apparatus comprises a quick-release mounting assembly disposed on at least one of said mounting plates. A mount is also disposed on a cross member located on the frame. The mount of the cross member preferably comprises a quick-release tri-pod mount.

In another embodiment of the present invention, the frame comprises a plurality of strap-mounting holes. The frame can also accommodate storage of the first arm assembly and the second arm assembly. The apparatus is preferably foldable to form a compact unit for storage and transport.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

Figure 1A:
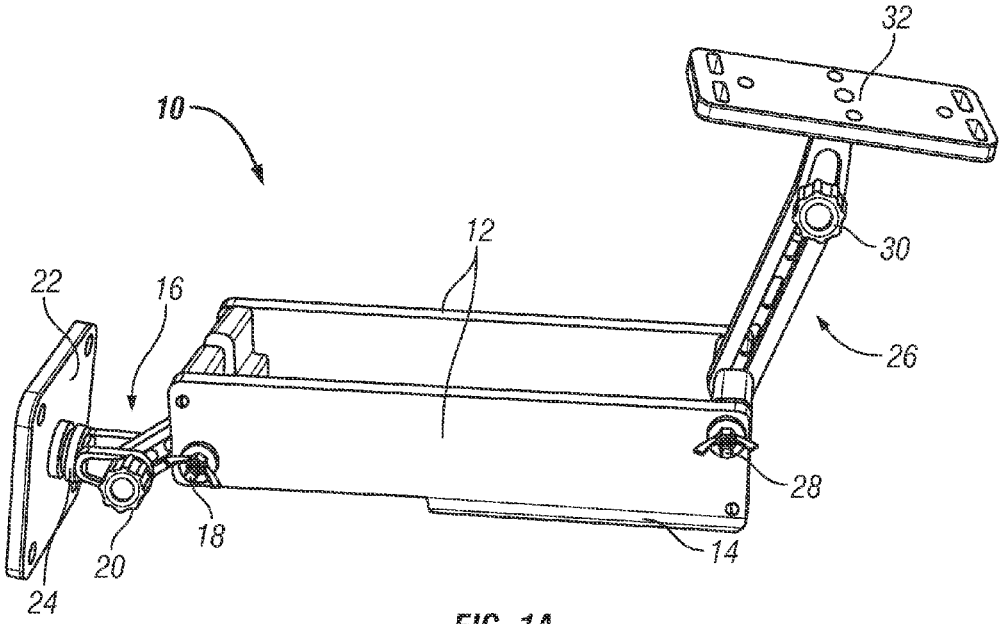
FIGS. 1A and 1B are drawings which illustrate an embodiment of the present invention in an un-folded position not being worn by a user.
Figure 1B:
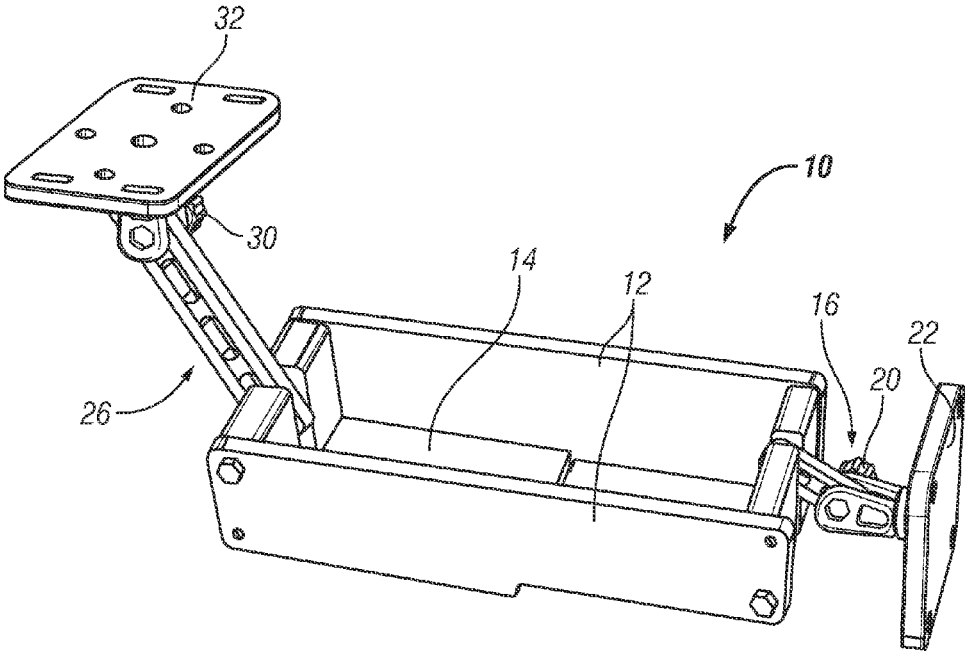

Embodiments of the present invention preferably relate to an apparatus that secures and supports handheld articles.

The term "article" as used throughout this application is intended to include any device, apparatus, assembly, component item, or like which a user may hold in his or her hand. Accordingly, the term "article" includes but is not limited to cameras, video recorders, rifles, pistols, binoculars, mobile phones, laptop computers, personal digital assistants, portable personal music players, combinations thereof, and the like.

The term "mounting plate" as used throughout this application is intended to mean any surface which is at least substantially rigid and upon which an article can be mounted and/or at least partially placed.

Referring now to the figures, holder 10 preferably comprises main body frame 12, fixedly secured together via cross member 14. First arm assembly 16 is preferably connected to a first end of frame 12. First arm assembly 16 is preferably pivotable with respect to body frame 12 via first arm frame pivot 18, which can preferably be locked into position via a fastening mechanism or other manner known to those skilled in the art. First arm assembly 16 also preferably includes first arm pivot 20, which also can preferably be locked into position via a fastening mechanism or other manner known to those skilled in the art. First arm assembly 16 is preferably connected to first mounting plate 22 at connection point 24, which can be a movably-positionable connection point, including but not limited to a ball-and-socket joint and/or a ball head joint, which allows for pivot or swivel motion. This movably adjustable connection point allows a user to keep their body still so as not to alert game or birds or any other creature, particularly when observing and/or hunting such creatures.

Figure 3:
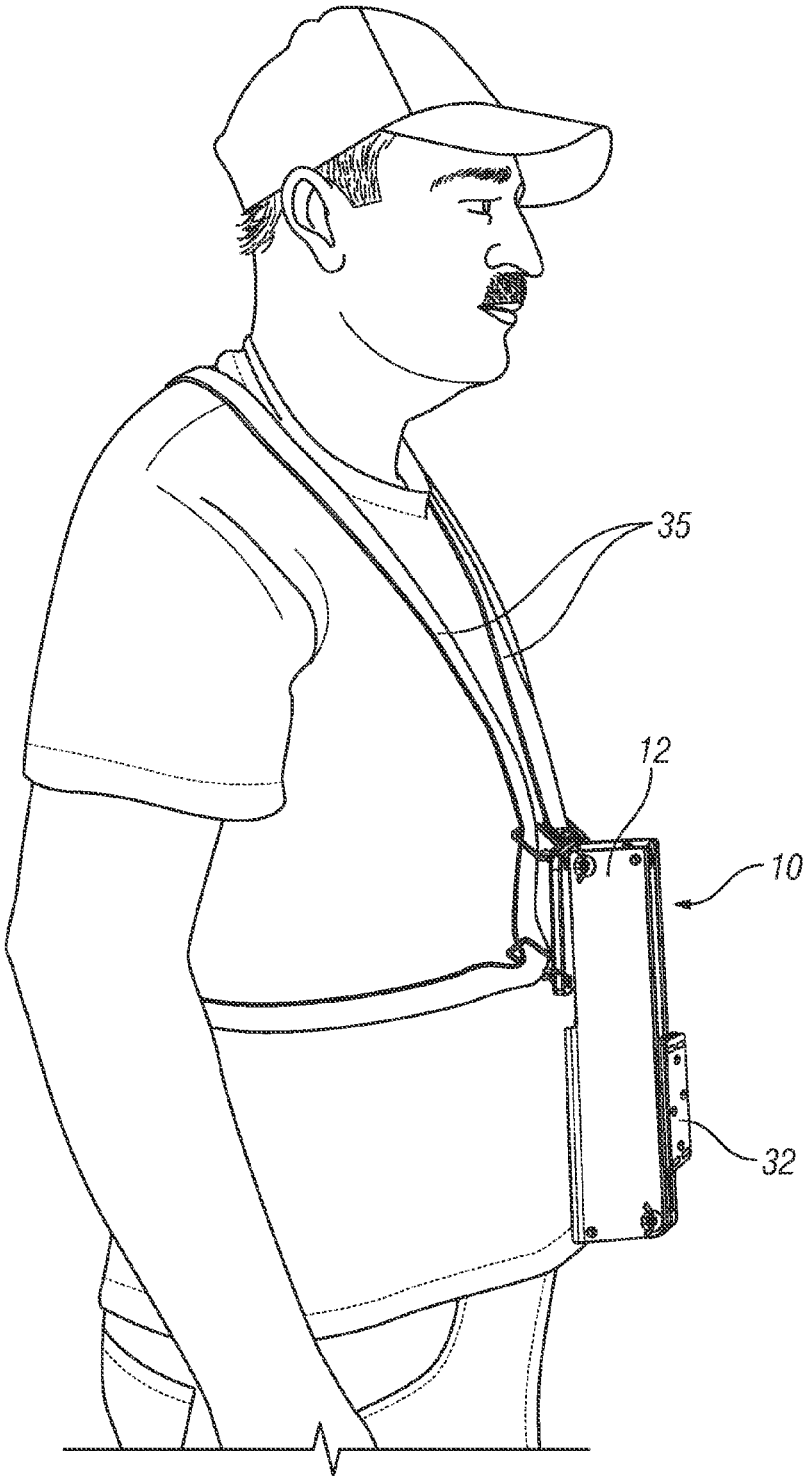
FIG. 3 is a drawing which illustrates an embodiment of the present invention in a folded position worn by a user.
Figure 4:
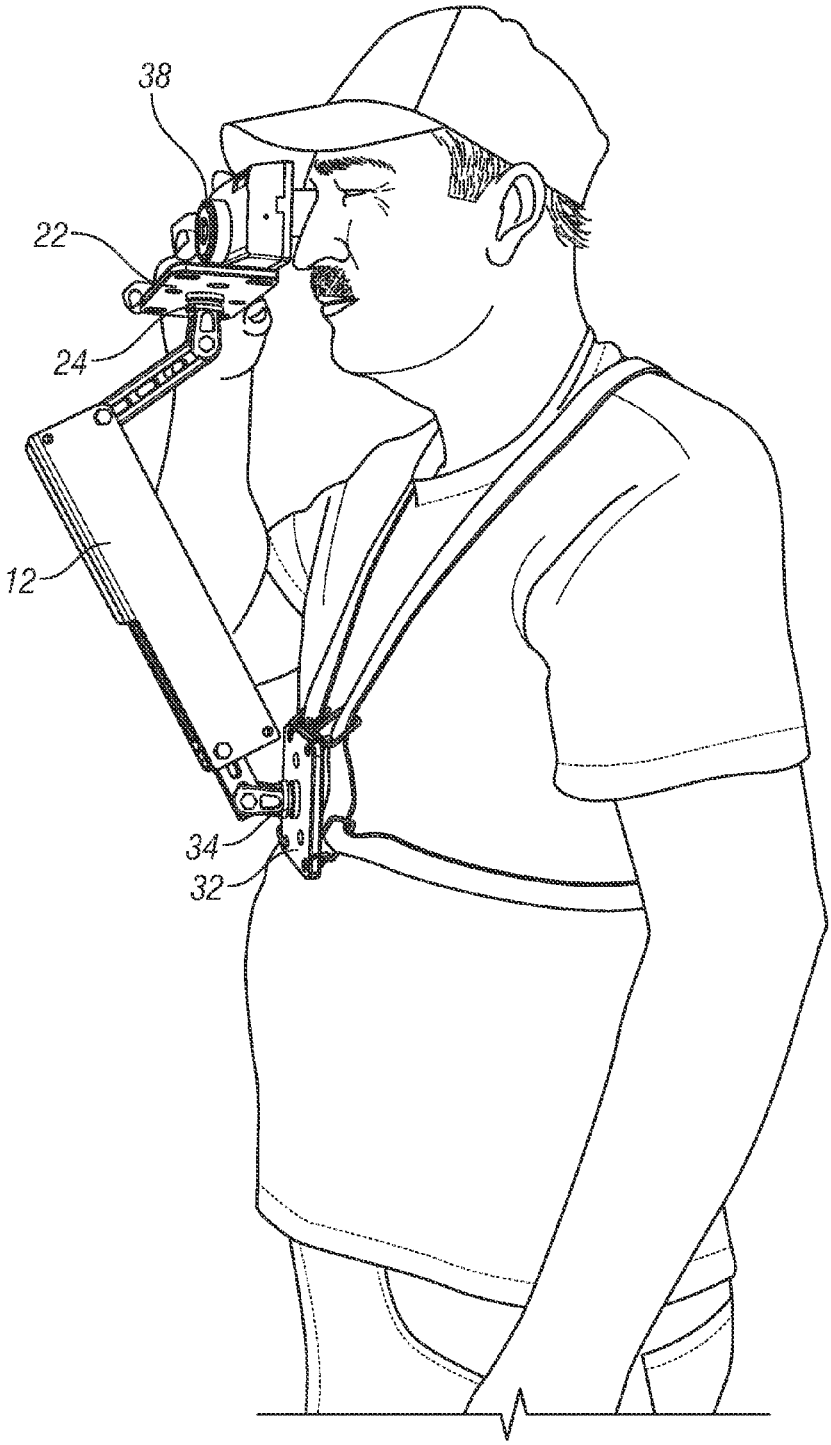
FIGS. 4-7 are drawings which illustrate an article disposed on an embodiment of the present invention wherein the article is in use or is in a position ready for use by a user.
Figure 9:
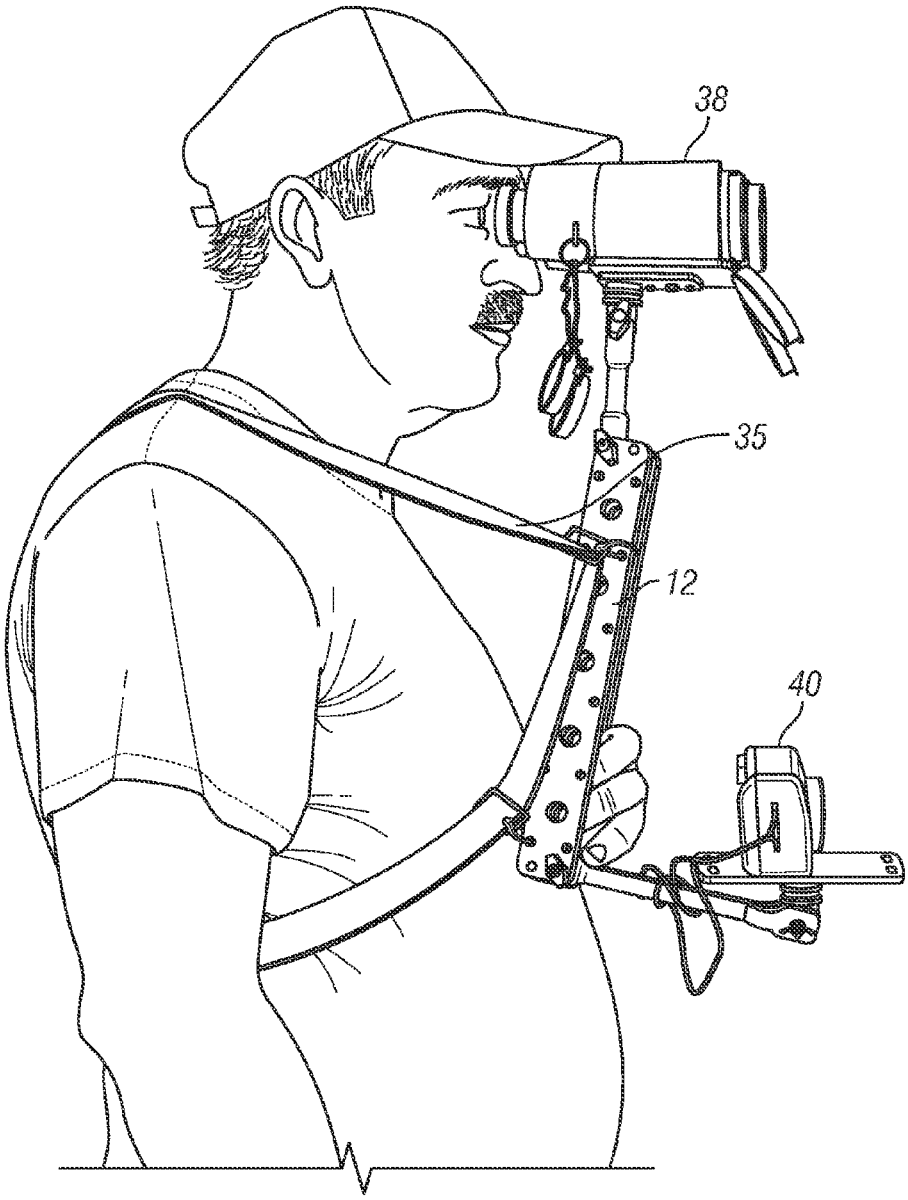
FIGS. 9-11 are drawings which illustrate a plurality of articles disposed on the holder of the present invention worn by a user.
Figure 10:
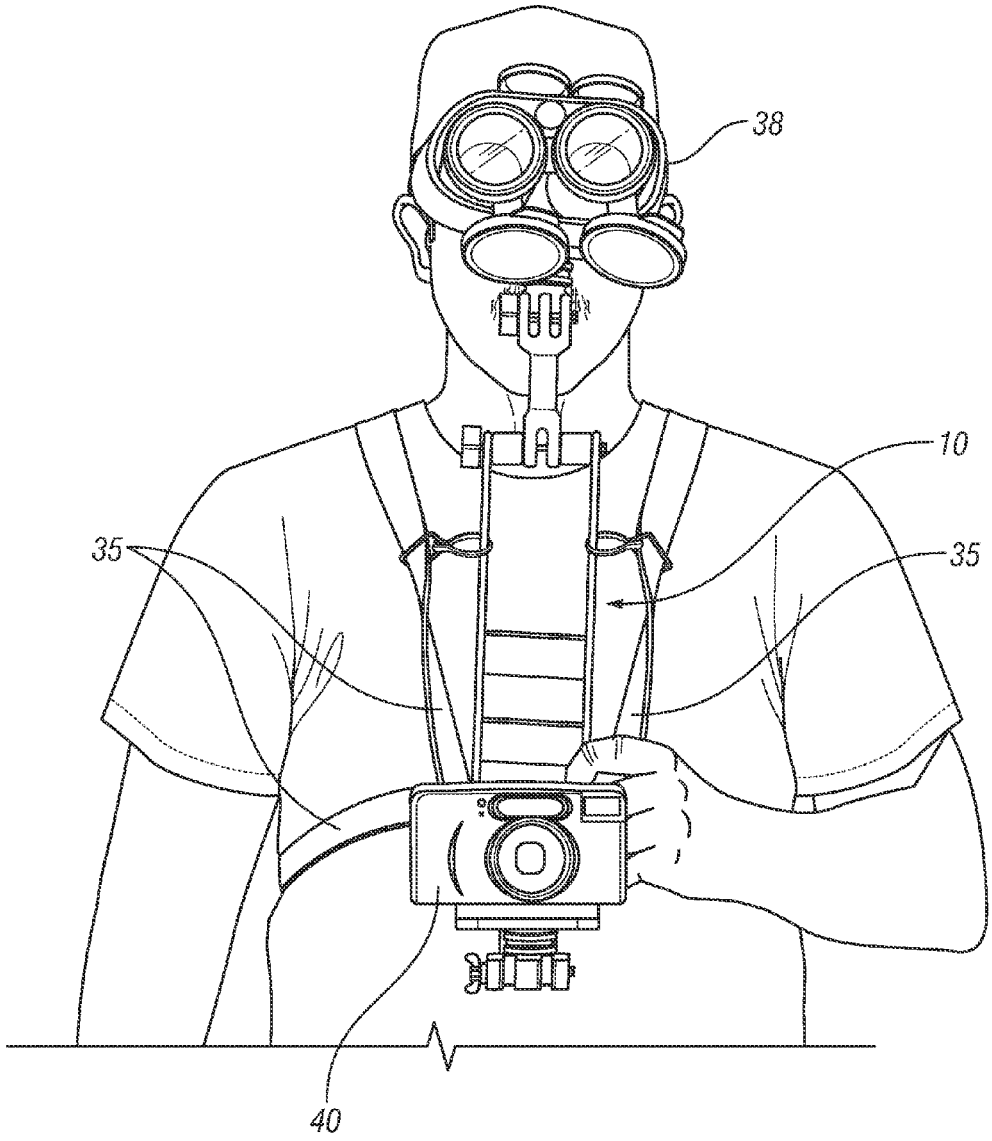

Second arm assembly 26 is preferably pivotally connected to a second end of body frame 12 via second arm frame pivot 28, which can preferably be locked into position via a fastening mechanism or other manner known to those skilled in the art. Second arm assembly 26 also preferably includes second arm pivot 30, which also can preferably be locked into position via a fastening mechanism or other manner known to those skilled in the art. Second arm assembly is preferably connected to second mounting plate 32 at connection point 34 (see FIG. 4), which can be a movably-positionable connection point, and like connection point 24, connection point 34 can also comprise a ball-and-socket joint and/or a ball head joint. As best illustrated in FIG. 3, straps 35 are preferably connectable to holder 10 such that a strap passes around the user's neck and around the user's waist and/or chest area. In one embodiment, straps 35 can connect to second plate 32 (see FIG. 4). When in this orientation, holder 10 is self-stabilizing as second plate 32 rests against the user's chest area. In an alternative embodiment, straps 35 can connect to the sides of frame 12 (see FIG. 9). As illustrated in FIG. 9, straps 35 can connect to and adjust via holes located on either side of frame 12. Of course, straps 35 are preferably provided with one or more adjustment mechanisms 36 (see FIG. 11). Further, as also best disclosed in FIGS. 9 and 11, frame 12 can optionally have a plurality of holes disposed in it in order to reduce the weight of holder 10.

In one embodiment, arm assemblies 16 and/or 26 can optionally incorporate one or more lockable pivot assemblies at pivot and/or connection points 18, 20, 24, 28, 30, and/or 34. Lockable pivot assemblies can include toothed, splined, and/or other friction generating configurations.

Figure 2:
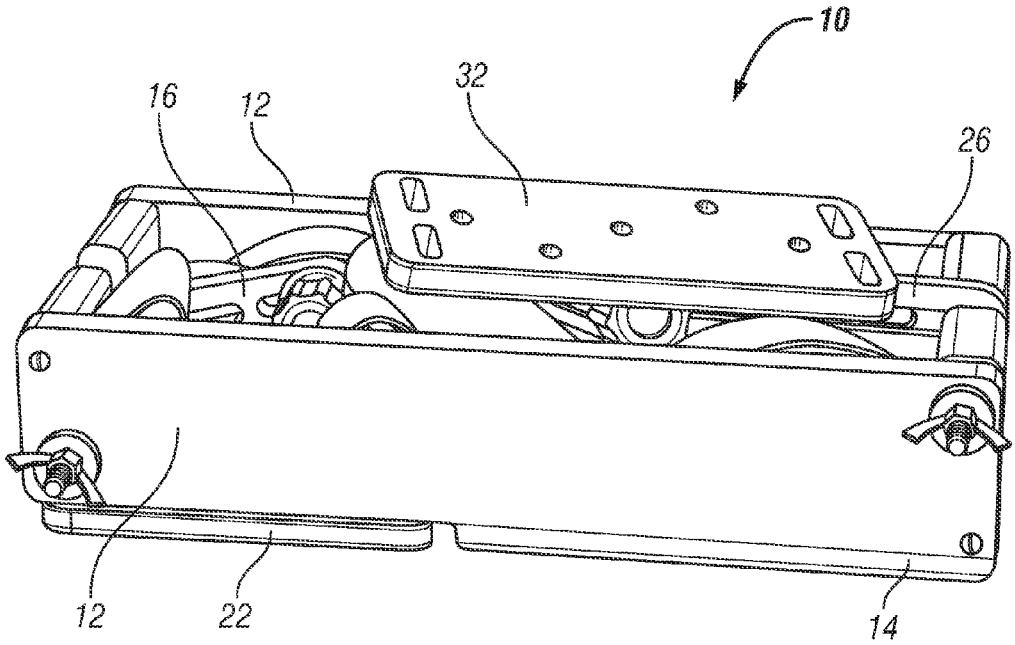
FIG. 2 is a drawing which illustrates an embodiment of the present invention in a folded position for storage.

As best illustrated in FIGS. 2 and 3, in one embodiment, first and second arm assemblies 16 and 26 can preferably be folded into main body frame 12 such that holder 10 comprises a small and compact unit when not in use. Thus, not only can holder 10 be stored in a compact position, it can also be worn by a user in a compact position when not in use (see FIG. 3).

Referring if FIGS. 4-7, first article 38 is preferably mounted to first and/or second plate 22 and 32, via a fastener including but not limited to a screw, pin, bolt, hook and loop tape twine, cable ties, combinations thereof and the like. First article 38 can also simply be held on the plate by the user or placed on the plate. When adjusted, holder 10 can be used hands-free or can be made to pivot or swivel in any direction. In one embodiment, all of the weight of the article is supported by holder 10. Optionally, however, holder 10 can be used to support only part of the weight of an article. This is particularly true for heavy articles such as a rifle.

Figure 5A:
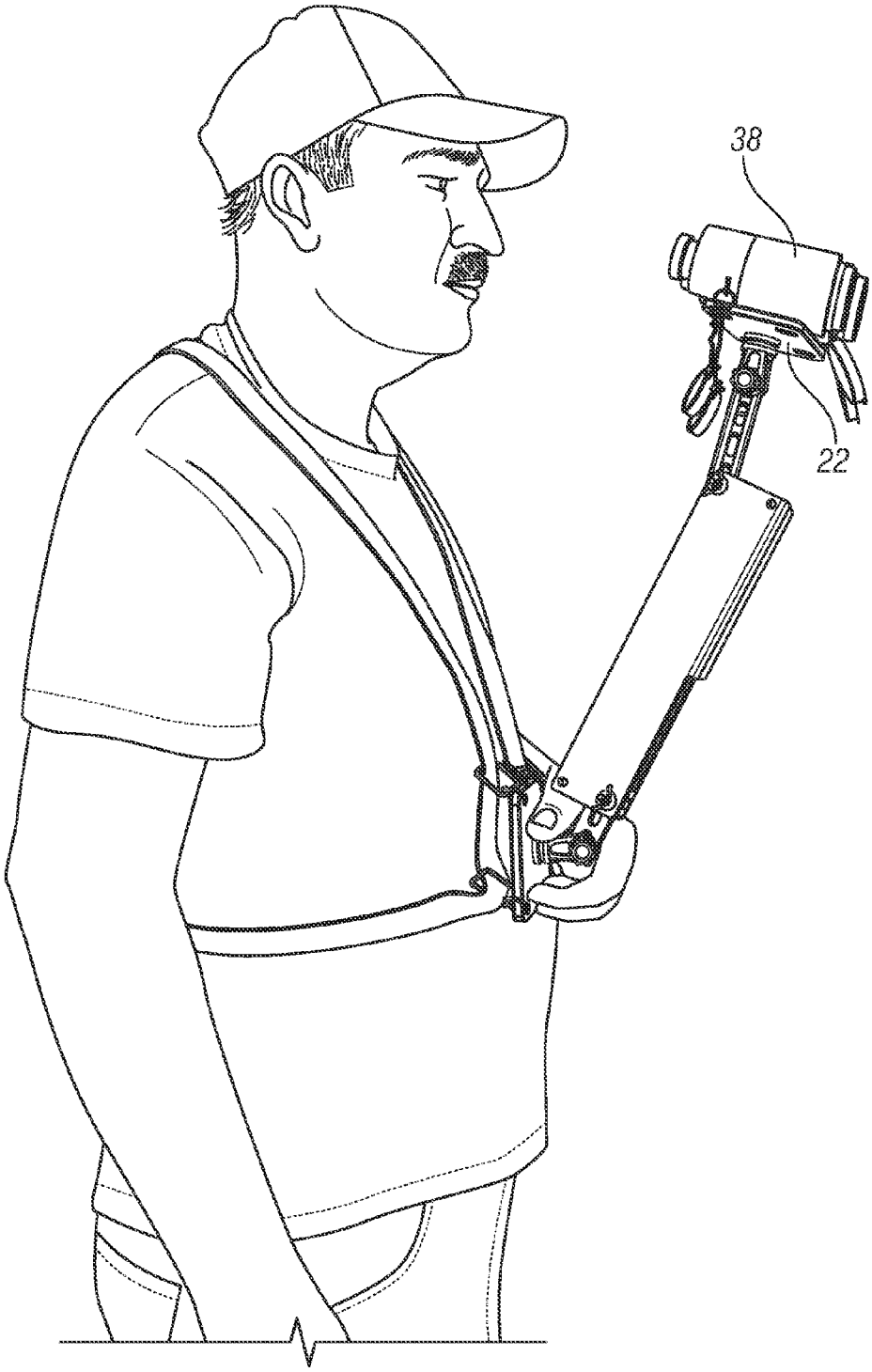
Figure 5B:
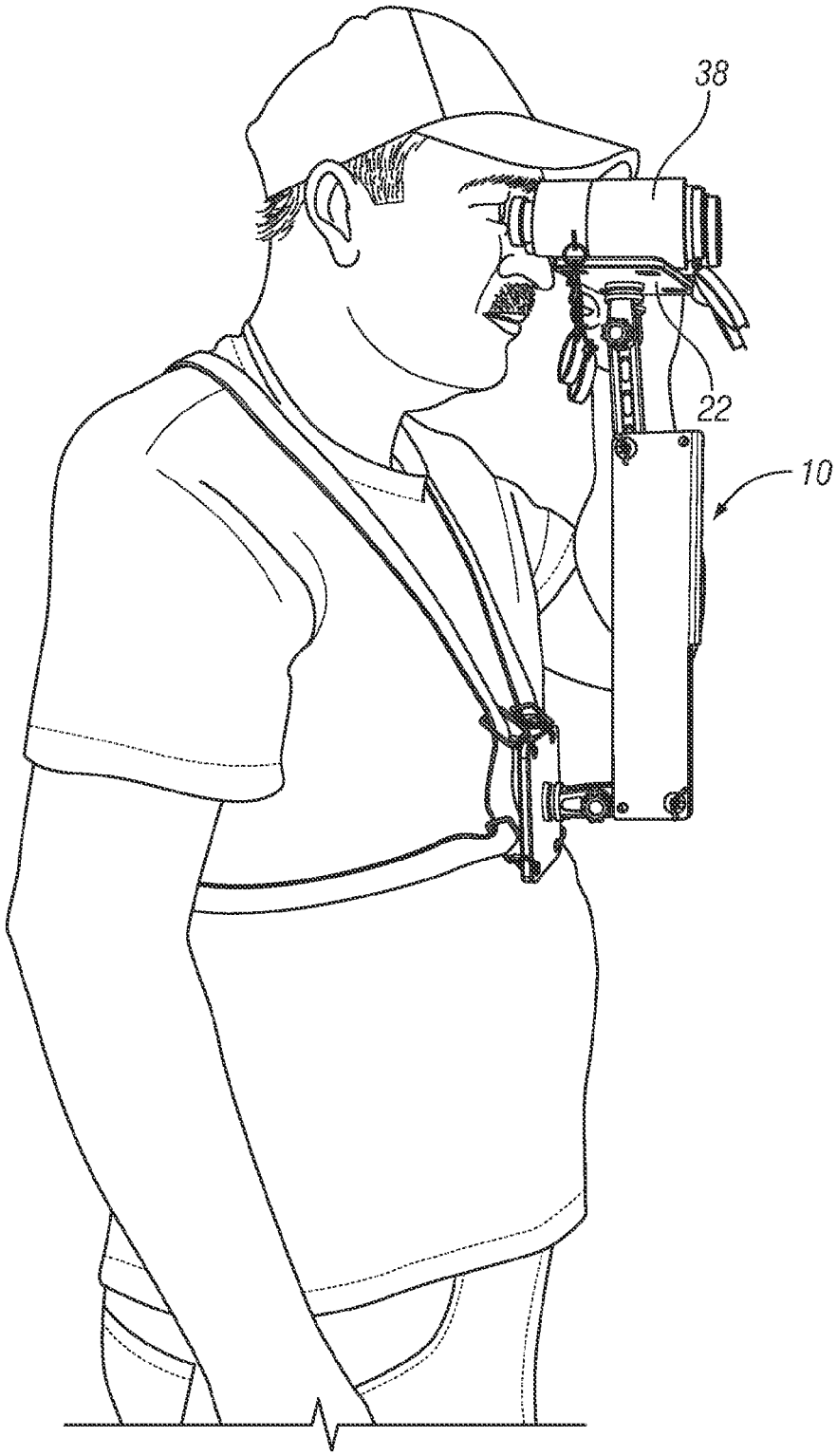
Figure 6:
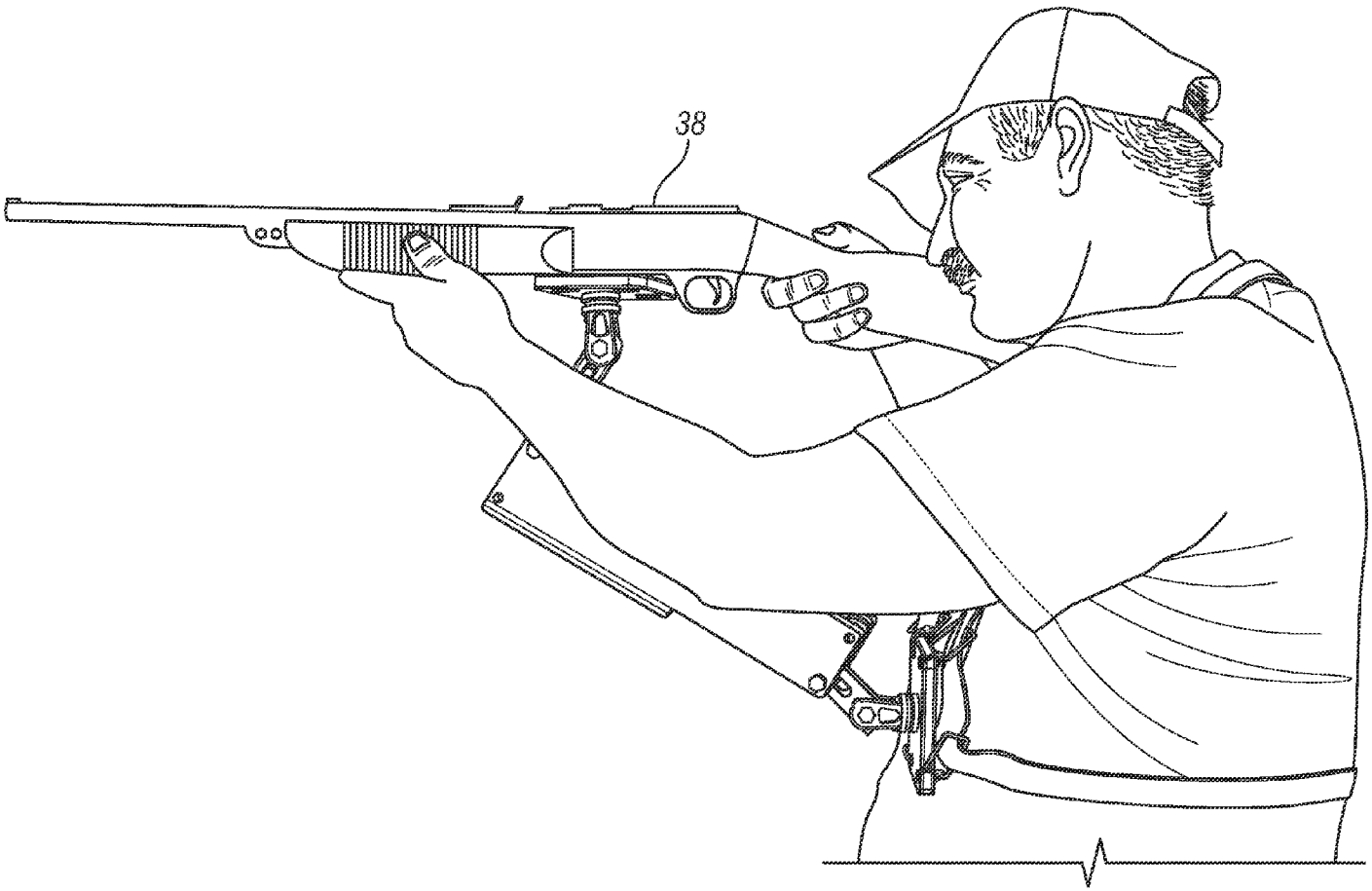
Figure 7:
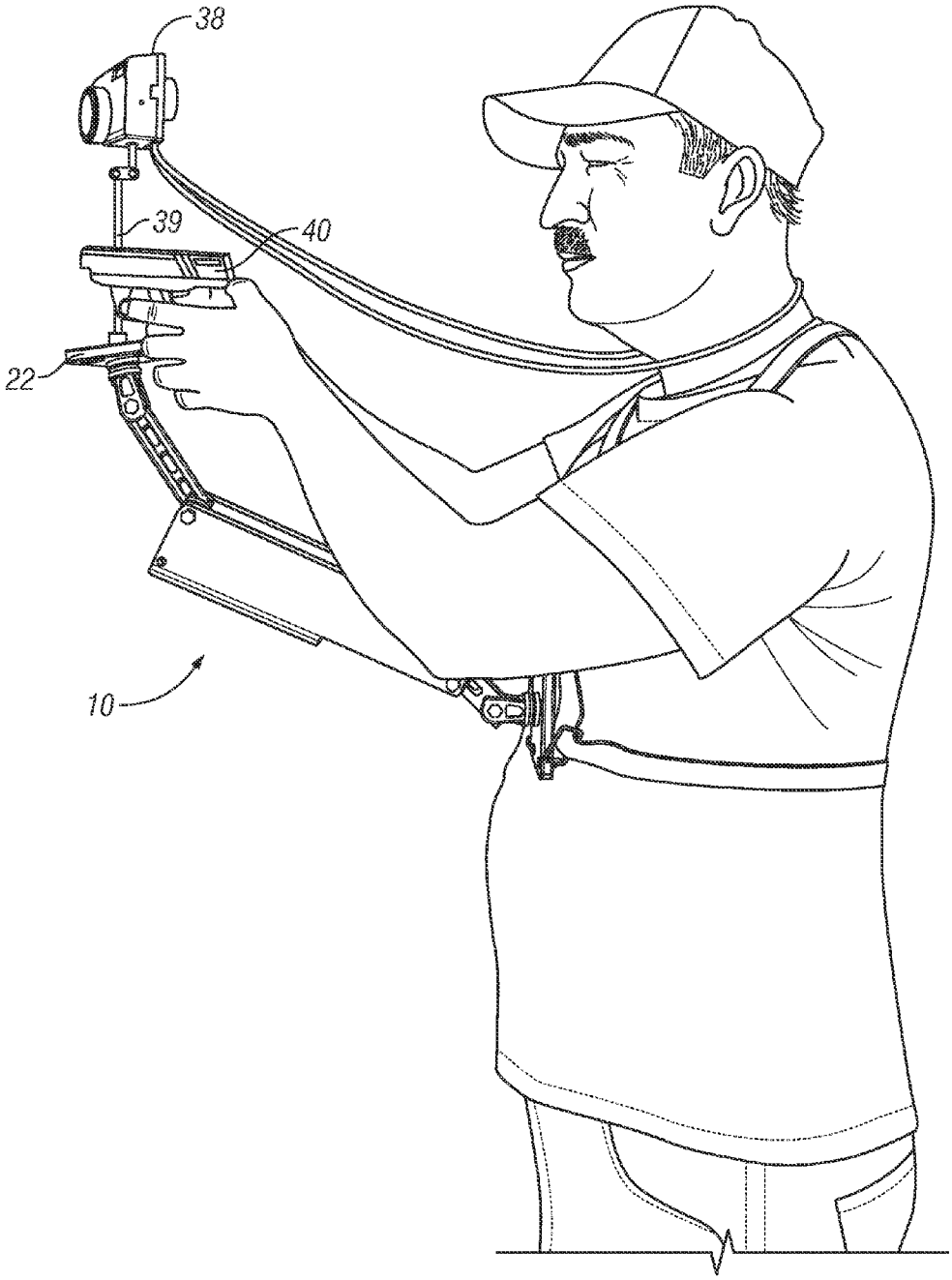
Figure 8:
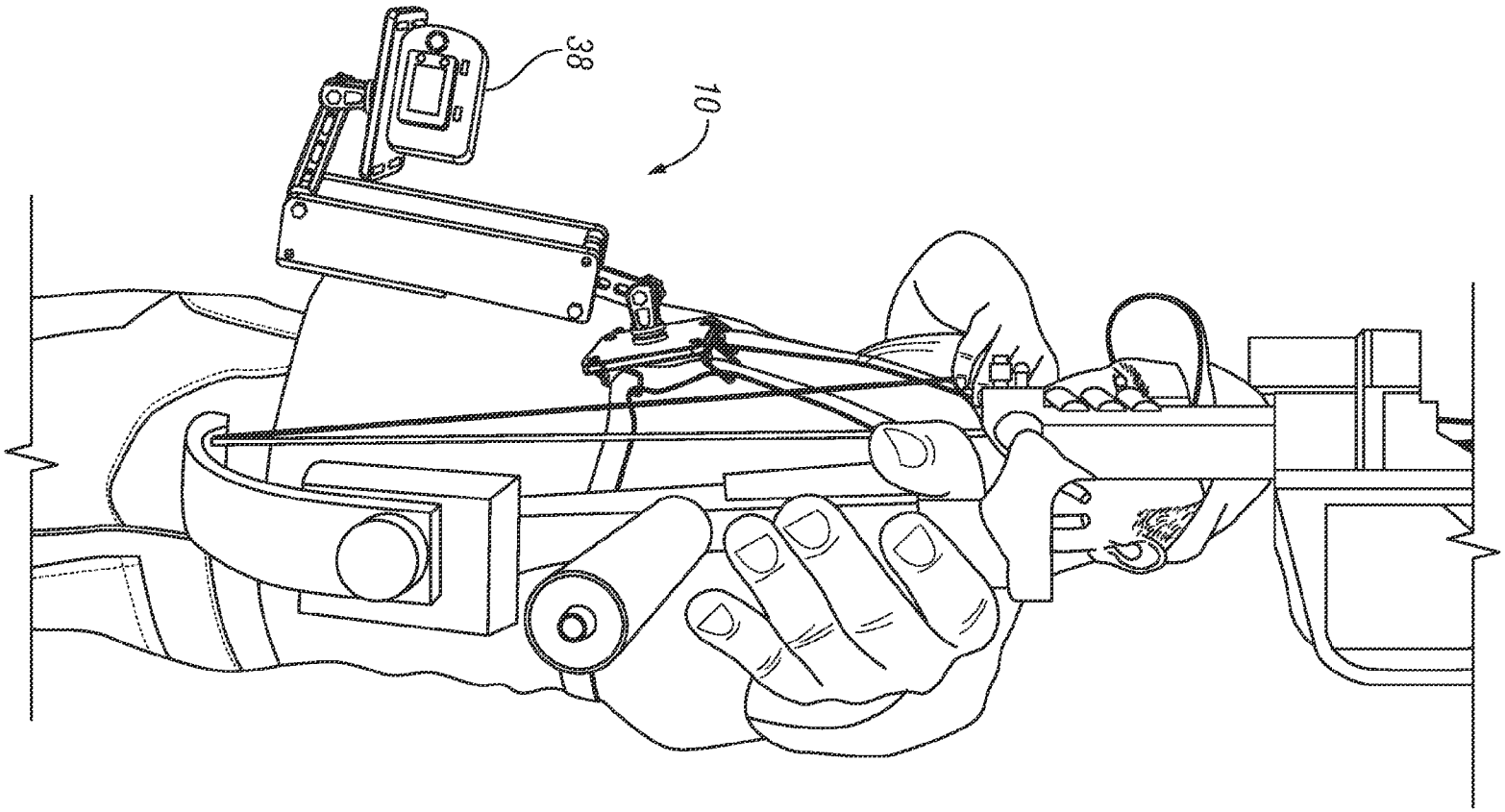
FIG. 8 is a drawing which illustrates an embodiment of the present invention wherein an article is disposed on the holder in a position out of the way of the user so that a user's chest area is cleared of obstructions.

In one embodiment of the present invention, holder 10 can be adjusted such that first article 38 is positioned at an eye-level of a user—see in particular FIGS. 4, 5B, 6, 10, and 11. As best illustrated in FIGS. 5A, and 7, because first and second arm assemblies 16 and 26 are preferably adjustable in a plurality of locations, first article 38, attached to first plate 22 can thus be positioned in virtually any orientation and location in front of a user, thus providing the user with a quick and easy way to securely position first article 38 out of the user's line of sight when the need arises. In addition, holder 10, with first article 38 disposed thereon can quickly be swiveled down away from the user's chest such that the user's chest area is clear for activities, such as drawing a bow (see FIG. 8). Accordingly, as illustrated in FIGS. 5A and 5B, a user can stand, sit, and gaze at things over head and need only glance forward to observe forwardly-distant things with ease through binoculars. A user can also easily adjust the binoculars to fold up against and/or near the user's chest if the binoculars need to be removed from eye level temporarily.

In one embodiment, holder 10 can optionally be positioned such that it is capable of holding first article 38 and second article 40 simultaneously (see FIG. 9). In this embodiment, first article 38 can be secured to first or second plate 22 or 32, and second article can be secured to the remaining plate. Optionally of course, either or both of the first and second articles 38 and 40 need not be secured, but rather can be placed and/or held onto its respective plate. In one embodiment, as illustrated in FIG. 9, first and second articles 38 and 40 can be supported by holder 10 while holder 10 is worn by a user. In this embodiment, straps 35 preferably connect to the sides of frame 12 such that first and second plates 22 and 32 are free to hold first and second articles 38 and 40. Optionally, straps 35 can connect to the sides of frame 12 via one or more clips through one or more holes disposed in frame 12. In one embodiment, additional holes can be provided in frame 12 such that straps 35 can be adjusted by selecting different holes in frame 12 for their connection points. In the embodiment wherein a plurality of articles is simultaneously held, main body frame 12 preferably rests against the chest area of the user for more stabilization. In this embodiment, second article 40 can optionally be orientated such that it is directed in the same orientation as first article 38 (see FIG. 9). In this manner, if first article 38 is a pair of binoculars and second article is a camera, the user will know that the camera is directed to whatever the user is observing through the binoculars. Thus, a user can move about and position his body to observe different things and simply press the button on the camera to capture an image of what the user is seeing through the binoculars.

In the embodiment of the present invention wherein a ball-and-socket joint or a ball head joint is provided at connection points 24 and/or 34, holder 10 can preferably hold articles securely at nearly any angle due to its nearly 360 degrees of rotation about virtually any axis. Connection points 24 and/or 34 can swivel and pivot and then when in the correct position tighten to securely hold an article in that position.

One or more mounting members and/or mounting mechanisms can optionally be disposed within holes on plates 22 and/or 32 (see FIGS. 1A-1B, 2, and 3), such that articles which have a standardized mounting mechanism can mate with, and thus, quickly and securely attach to plates 22 and/or 32, including the quick release mounts which are commonly used to mount a video camera to a tripod. The mounting members and/or mounting mechanisms can be screws of any length. FIG. 7 illustrates an embodiment of the present invention comprises mounting member 39 holding first article 38 above first plate 22 in order to accommodate a user resting second article 40 on first plate 22.

Figure 11:
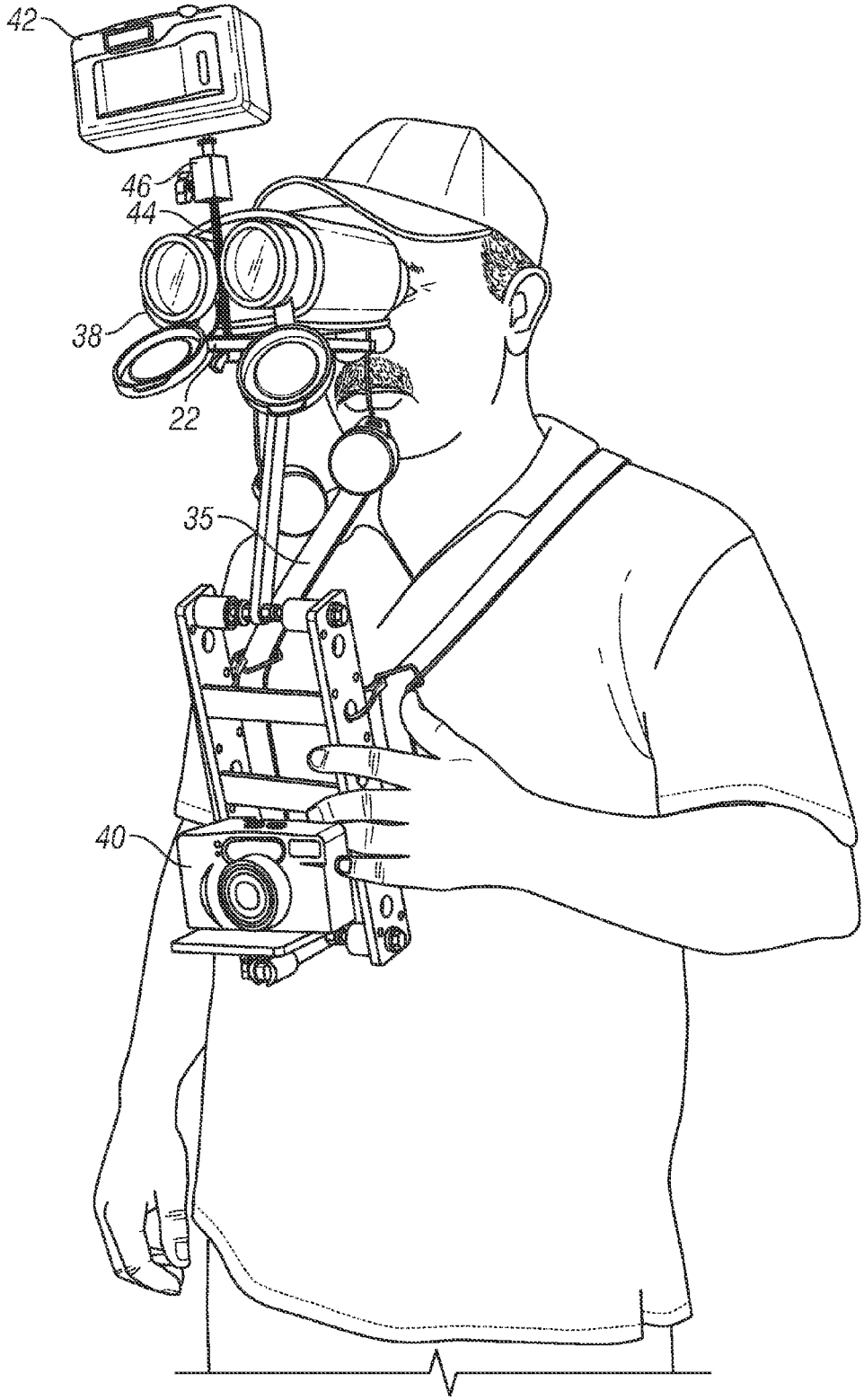

Plates 22 and/or 32 can accommodate more than one article by using different sizes of mounting members and/or mounting mechanisms (see FIG. 11). FIG. 11 illustrates an embodiment of the present invention comprising plate 22 that is securely holding both third article 42 and first article 38 using two mounting members with different lengths. Mounting member 44 securely holds third article 42 to plate 22. Mounting member 44 preferably comprises lockable pivot assembly 46. Lockable pivot assembly 46 preferably rotates, pivots and/or swivels so a user can position the camera. Once third article 42 is in place, lockable pivot assembly 46 can lock to hold third article 42 in place. The longer mounting member thus securely holds third article 42 above first article 38. First article 38 is preferably secured to plate 22 via a mounting member comprising a fastener.

Figure 12:
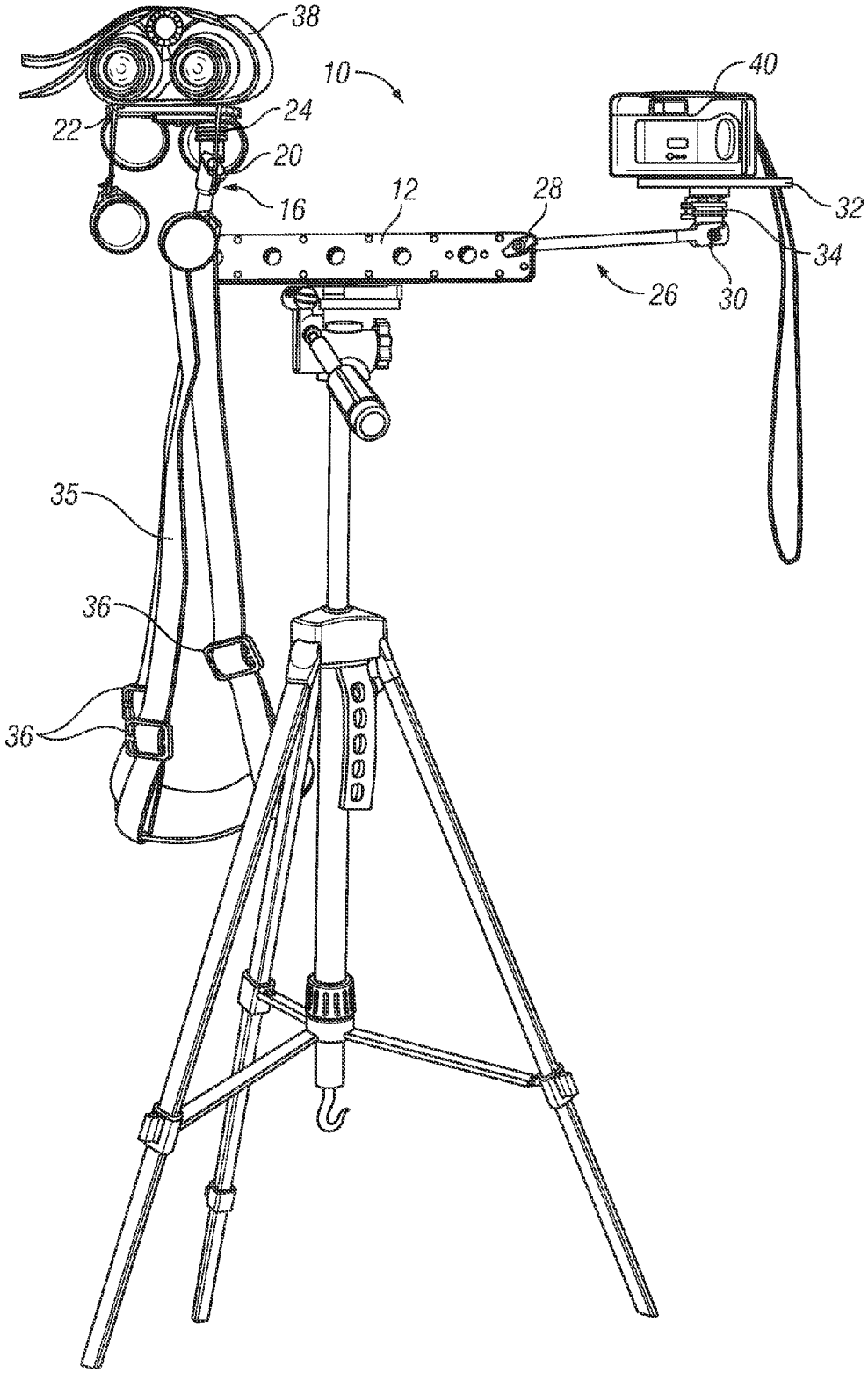
FIG. 12 is a drawing which illustrates a plurality of articles disposed on the holder of the present invention attached to a tripod.
Figure 13:
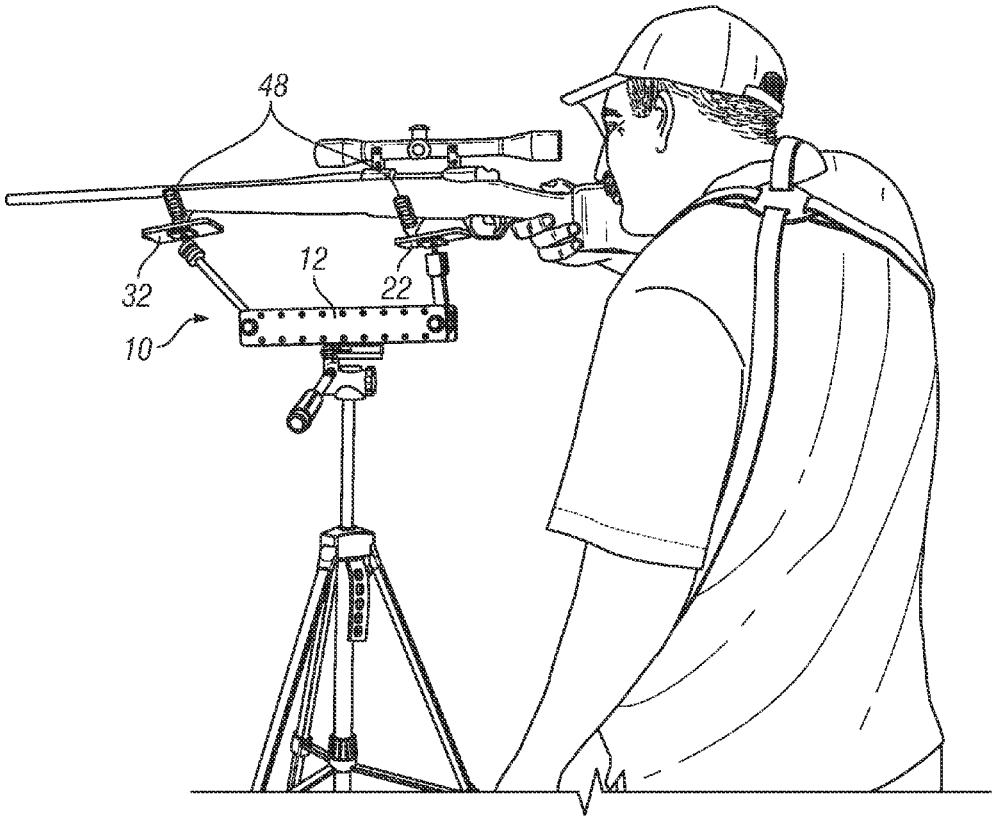
FIG. 13 is a drawing which illustrates an article disposed on a rifle support that is connected to the holder of the present invention attached to a tripod.

In one embodiment of the present invention, holder 10 can be clamped, tied, mounted, or set up on virtually any surface capable of supporting its weight, including but not limited to the ground, a table, a post, a tree, a tripod, combinations thereof or the like, or hung from virtually any location capable of supporting the weight of holder 10. When placed upon a surface, holder 10 can be free-standing. FIGS. 12 and 13 illustrate embodiments of the present invention wherein holder 10 is mounted onto a tripod. Referring to FIG. 12, holder 10 is secured to a tripod via a cross member in body 12 (see cross member 14 in FIG. 1B). First plate 22 preferably secures first article 38 and second plate 32 preferably secures second article 40. FIG. 13 comprises a rifle mount attached to holder 10. The rifle mount preferably comprises v-notches 48 to support a rifle. V-notches 48 can also optionally comprise a roller mechanism so that the rifle can roll forward and backward.

Figure 14:
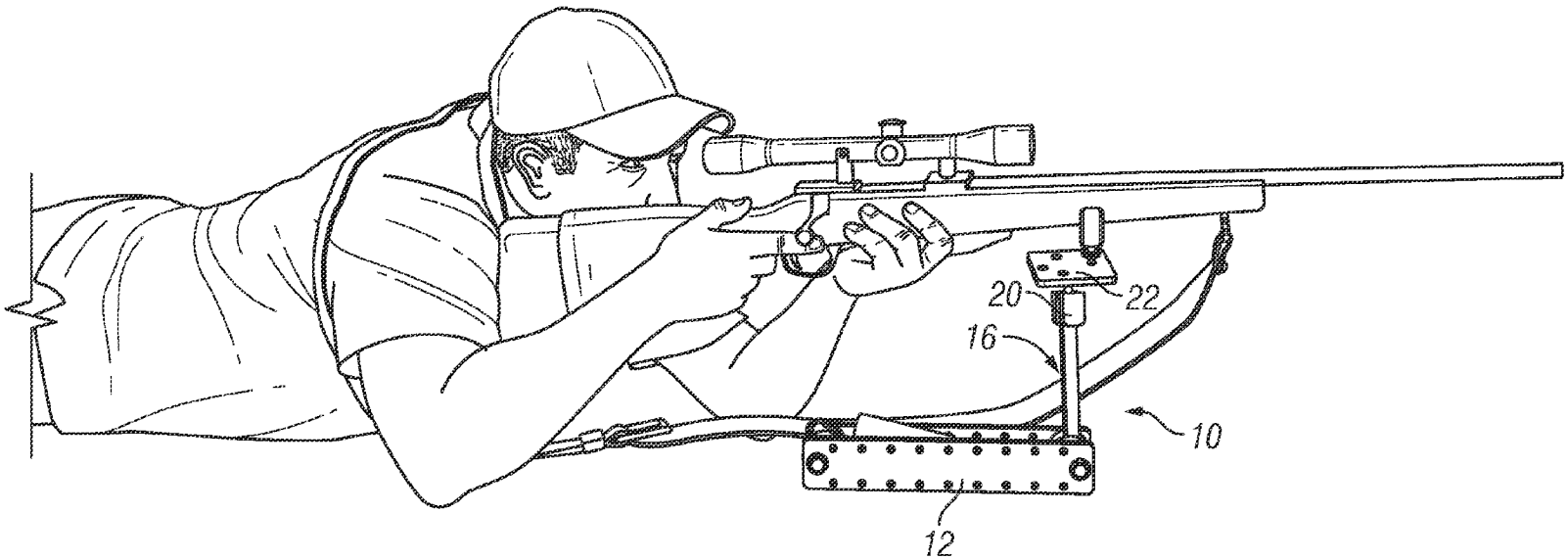
FIG. 14 is a drawing which illustrates an embodiment of the present invention wherein the holder is positioned on the ground so a user can hold an article in the prone position.

When used in conjunction with a firearm, a rifle or pistol can optionally be adequately supported in all four of the universal shooting positions, which include standing, sitting, kneeling, and the prone position. FIG. 14 illustrates holder 10 being used while a user is in the prone position.

Because an embodiment of the present invention provides a small, lightweight, convenient, foldable and easy to store article holder which can be worn by a user, it can be used nearly all the time while sitting, walking, standing, riding in a vehicle, boat, quad, bike, airplane, and the like. Because of the movably positionable arm assemblies of an embodiment of the present invention, holder 10 can, when placed on a ground surface, hold an article anywhere from a couple of inches above a ground surface, and extend to a couple of feet above a ground surface with an almost infinite range of positions and heights. Of course, embodiments of the present invention can be provided which are larger and/or smaller than the embodiment illustrated in the figures, for example, a non-wearable embodiment of the present invention can have frame and arm assemblies that are several feet long.

Embodiments of the present invention are particularly useful for assisting persons who have a disability in holding an article. For example holder 10 can greatly assist a single-armed person to hunt, bird watch, and photograph. Embodiments of the present invention thus permit handicapped people, as well as small children, and the elderly, the opportunity to participate in different activities which they otherwise have difficulty or cannot participate in.

Optionally, one or more of the arm assemblies and/or plates can be removed and/or replaced with mounting assembly. For example, in one embodiment, mounting plate 32 can be removed and replaced with a video camera quick-mount.

Because embodiments of the present invention permit a user to simultaneously hold a plurality of articles while leaving the user's hands free, the user can thus hold a plurality of articles with holder 10 and still hold more articles in the user's hands. Such a configuration is thus particularly helpful for photographers and/or videographers such that they can quickly and conveniently hold and operate several still and/or video cameras.

Optionally, in one embodiment, a plurality of arm assemblies and plates can be provided at one or both ends of frame 12. In one embodiment, one or both of arm assemblies 16 or 26 can comprise an extending rod or similar telescoping structure which thus provides additional reach to the arm assembly. Accordingly, such an extending rod structure can optionally be rotated such that it effectively forms a leg which stabilizes the unsupported end of holder 10. In this embodiment, one of plates 22 or 32 can provide support against a user's abdomen, the other plate can provide support on the ground through an extending rod, and an article can be mounted on frame 12.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A wearable holding apparatus comprising:

a frame, said frame comprising a first end and a second end;

a foldable first arm assembly hingedly disposed on said first end of said frame;

said first arm assembly comprising a first arm pivot point having a lockable pivot assembly;

a foldable second arm assembly hingedly disposed on said second end of said frame;

said second arm assembly comprising a second arm pivot point having lockable pivot assembly;

a first mounting plate disposed on said first arm assembly, said first mounting plate movably positionable and able to swivel about said first arm assembly; a second mounting plate disposed on said second arm assembly;

said frame comprising at least one abdominal strap and at least one neck strap; and said frame accommodating storage of said first arm assembly and said second arm assembly.

2. The apparatus of claim 1 wherein said lockable pivot assembly comprises a splined configuration.

3. The apparatus of claim 1 wherein said second mounting plate is movably positionable about said second arm assembly.

4. The apparatus of claim 3 further comprising a plurality of strap-connector connections.

5. The apparatus of claim 3 further comprising at least one securing strap.

6. The apparatus of claim 1 further comprising at least one strap connected to one of said mounting plates.

7. The apparatus of claim 1 further comprising at least one strap connected to said frame.

8. The apparatus of claim 1 further comprising a quick-release mounting assembly disposed on at least one of said mounting plates.

9. The apparatus of claim 1 wherein said frame comprises a cross member and wherein said cross member comprises a mount.

10. The apparatus of claim 9 wherein said mount of said cross member comprises a quick-release tri-pod mount.

11. The apparatus of claim 1 wherein said frame comprises a plurality of strap-mounting holes.

12. The apparatus of claim 1 wherein said apparatus is foldable to form a compact unit for storage and transport.

* * * * *